US005184382A

United States Patent [19]

Ward et al.

[11] Patent Number: 5,184,382

[45] Date of Patent: Feb. 9, 1993

[54] PNEUMATICALLY DRIVEN DESCALING TOOL

[75] Inventors: James E. Ward, Glendora, Calif.; Leo Swan, Jefferson, Md.

[73] Assignee: Equipment Development Company, Inc., Frederick, Md.

[21] Appl. No.: 747,968

[22] Filed: Aug. 21, 1991

[51] Int. Cl.[5] ..... B21C 43/00

[52] U.S. Cl. ..... 29/81.15; 29/81.17; 173/169

[58] Field of Search ..... 7/143, 146, 147; 15/93; 29/81.13, 81.11, 81.15, 81.17; 173/168, 169, 170

[56] References Cited

U.S. PATENT DOCUMENTS

| | | | |
|---|---|---|---|
| 2,136,595 | 11/1938 | Rodgers | 29/81.17 X |
| 2,356,314 | 8/1944 | Gray et al. | 29/81.17 X |
| 3,571,874 | 3/1971 | Arx | 29/81.17 X |
| 4,321,722 | 3/1982 | Klocke | 174/169 X |

FOREIGN PATENT DOCUMENTS

| | | | |
|---|---|---|---|
| 251913 | 5/1926 | United Kingdom | 79/81.15 |

*Primary Examiner*—Timothy V. Eley

*Attorney, Agent, or Firm*—Birch, Stewart, Kolasch & Birch

[57] ABSTRACT

A pneumatically driven impact type of descaler tool includes a manually gripped housing having a rear portion of generally circular cross-section which includes therein a pneumatically driven reciprocating piston assembly which acts as a hammer and a right angled forward portion having a forwardly tapered nose which is particularly adapted for fitting into corners of a workspace. A pivoted solid arcuate body shaped in the form of a quarter circle forms an anvil. A descaling head is secured to the lower end of the anvil and is adapted to be actuated at the other end by the piston assembly which imparts a srelatively strong repetitive impact motion to the descaling head when held against a metal work surface.

16 Claims, 3 Drawing Sheets

PNEUMATICALLY DRIVEN DESCALING TOOL

BACKGROUND OF THE INVENTION

This invention relates generally to power tools for removing paint, rust, scale or corrosion from a metal surface and more particularly to a hand-held vibratory type descaling tool which, in addition to providing a descaling operation, also is adapted to provide a scored profile on a metal surface in order to present a more positive gripping surface for paint, urethane, or epoxies and the like.

Various techniques and forms of machines and devices have been developed for abrading work surfaces. Included in such devices are the known types of sanding and grinding machines. Also generally known are impact type of tools which in one way or another chip, scarify or otherwise roughen the surface of a deck/floor, bulkhead/wall or overhead/ceiling.

SUMMARY

Accordingly, it is an object of the present invention to provide an improvement in hand-held power tools.

It is another object of the invention to provide an improvement in pneumatically driven power tools.

It is a further object of the invention to provide a pneumatically driven impact type descaling tool for removing paint, rust, corrosion or other undesirable material from a metal surface.

And it is still another object of the invention to provide a pneumatically driven descaler type of impact tool which provides an abraded type of profile on a metal surface for better coating adhesion.

These and other objects and advantages are achieved by a pneumatically driven impact type of descaler tool comprised of a manually gripped housing having a rear housing portion of generally circular cross-section which includes therein a pneumatically driven reciprocating piston assembly which acts as a hammer and a right angled forward housing portion having a tapered nose which is particularly adapted for fitting into corners and which includes therein a pivoted quarter circular solid arcuate body which forms an anvil having a descaling head secured to the outer end thereof and which is adapted to be actuated at the other end by the piston assembly which imparts a relatively strong repetitive impact motion to the descaling head.

BRIEF DESCRIPTION OF THE DRAWINGS

The following detailed description of the invention will be more readily understood when considered together with the accompanying drawings wherein.

DETAILED DESCRIPTION OF THE INVENTION

Figure 3:
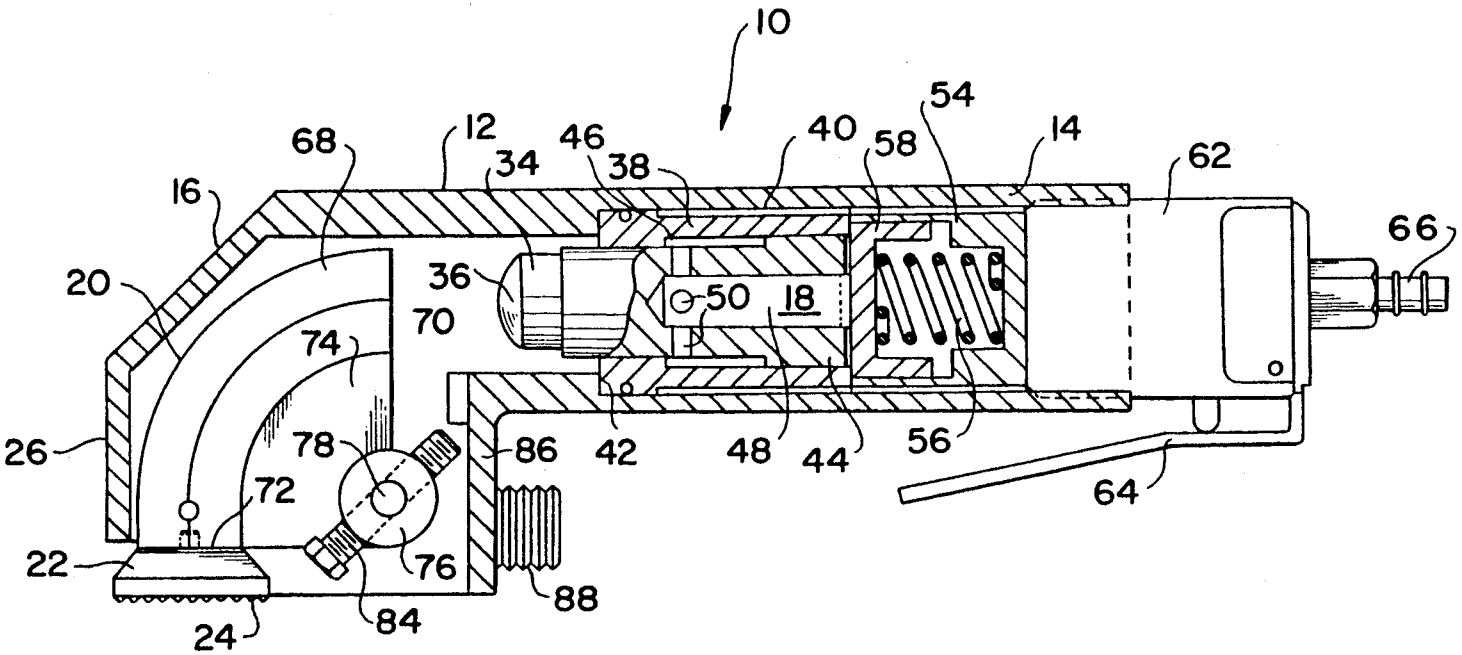
FIG. 3 is a central longitudinal cross section illustrative of the preferred embodiment of the invention.
Figure 4:
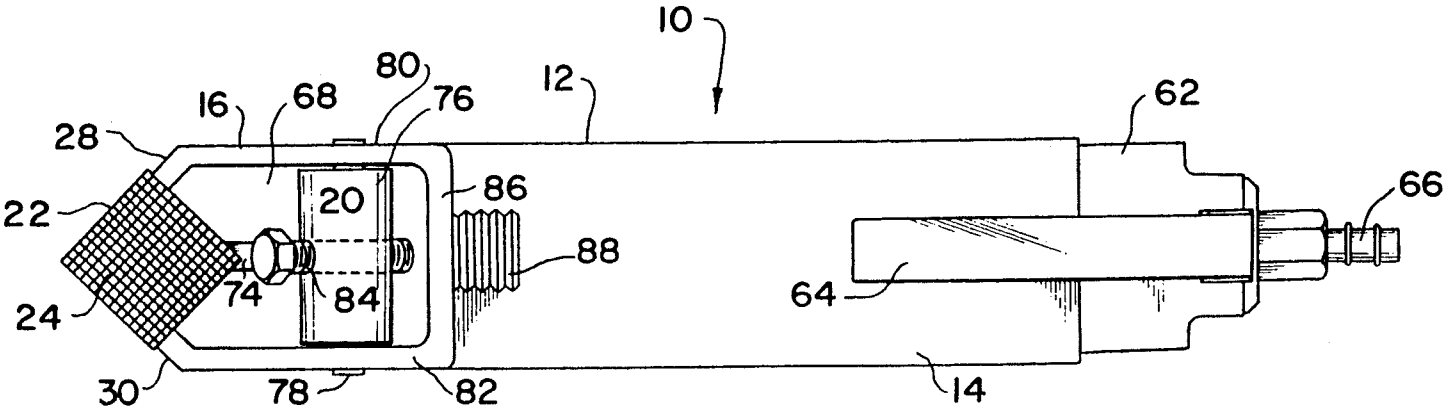
FIG. 4 is a bottom plan view of the preferred embodiment shown in FIG. 3.

Referring now to FIGS. 1-5 of the drawings, reference numeral 10 designates a pneumatically driven descaling tool in accordance with the subject invention and is comprised of, among other things, a right angled housing 12 consisting of an elongated rear handle section 14 and a front end head section 16. The interior of the housing 12, as shown in FIG. 3, is adapted to accommodate a pneumatically driven hammer assembly 18 which is located in the handle section 14 and an arcuate anvil type member 20 located in the head section 16. An abrasive type of descaling head 22 designed to remove paint, rust, scale, corrosion or other materials from a work surface such as a steel plate, not shown, is attached to the distal or outer end of the anvil member 20 and includes an external scaling pad member 24 having a diamond textured face for providing, for example, a 2 to 4 mil profile for providing a positive gripping surface for paint, urethane epoxies and the like.

Figure 1:
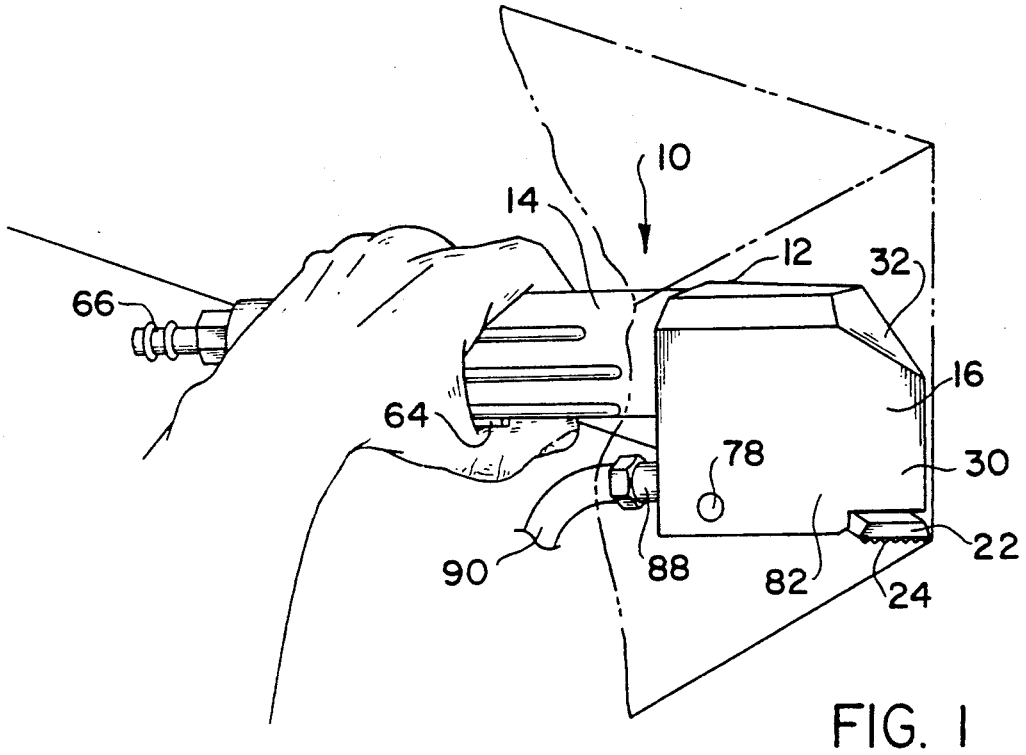
FIG. 1 is a perspective view generally illustrative of the manner in which the preferred embodiment of the subject invention is used.
Figure 2:
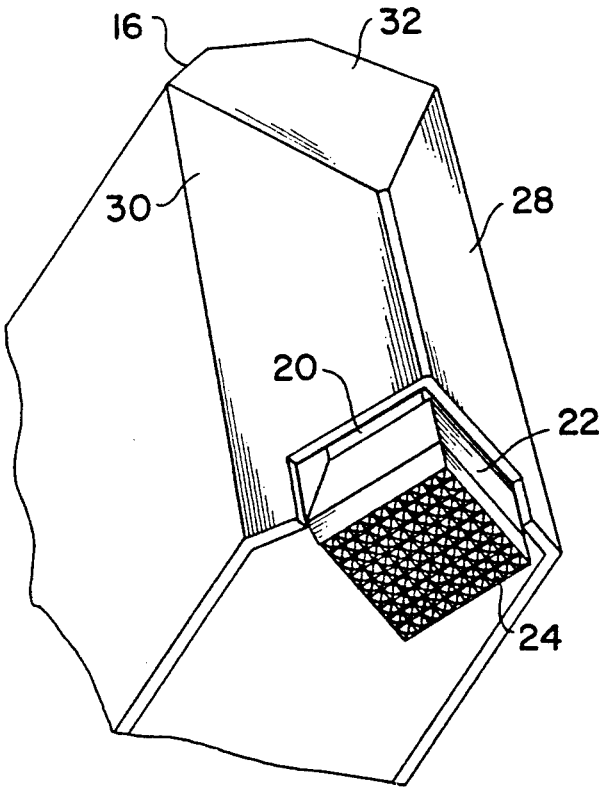
FIG. 2 is a perspective view generally illustrative of the nose portion and descaling head attached thereto.

The descaling head 22 and pad 24 are generally rectangular in shape and oriented so that one corner projects outwardly from a tapered nose portion 26 of the head section 16 consisting of a pair of front walls 28 and 30, which come together at a right angle. This type of configuration permits the tool 10 and the descaling head 22 to operate in the square corners of a workspace as shown in FIG. 1. Adjacent the two right angled walls 28 and 30 is an inclined generally flat wall 32 (FIG. 2) which slopes upwardly to the upper outer surface of the handle 14. This permits easier access to small spaces.

Figure 5:
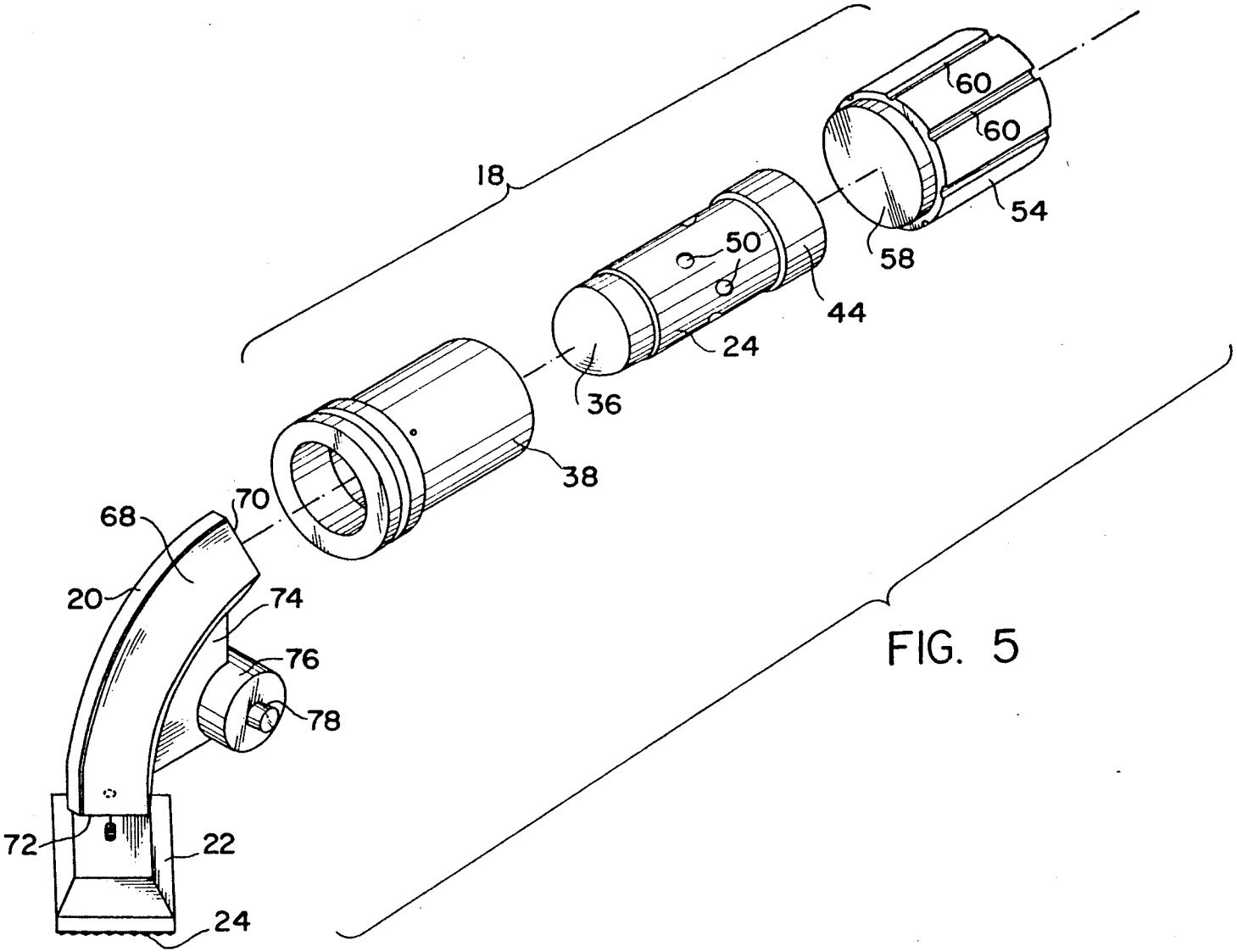
FIG. 5 is an exploded view of the components included in the housing as shown in FIG. 3.

Turning attention now to the details of the hammer assembly 18, as shown in FIG. 3, for example, it is comprised of an elongated piston type member 34 having a rounded forward tip 36 comprised of hardened metal. The piston 34 is located and is adapted to reciprocate within an outer cylinder 38. The cylinder 38 is slidably inserted in an elongated axial bore 40 where it abuts a restraining shoulder 42. The piston member 34, moreover, includes a rear shoulder portion 44 which is slightly larger than the body portion. In its travel in the forward direction, the piston member 34 can only travel to the abutment provided by the inside shoulder 46. The piston 34, moreover, includes a central axial bore 48 and a plurality of transverse holes 50 as shown in FIG. 5.

Immediately behind the piston 34 and cylinder 38 is a cylindrical subassembly comprising a body member 54 which is adapted to house a compression spring 56 and a movable end cap 58 which is adapted to contact the rear of the cylinder 34. The body member 54 also includes a plurality of longitudinally extending slots 60 as shown in FIG. 5 on its outer surface which extend from front to back. The purpose of the slots 60 is to permit compressed air delivered from a manually operated valve 62 located in the rear end of the handle portion 14 to be delivered to the hammer, i.e. the piston 34.

Further as shown, the valve 62 includes a manually operated handle 64 and an air hose attachment coupling member 66. In operation, when the handle 64 is depressed, compressed air is delivered from the valve 62 to the bore 48 of the piston 34 where it is driven forward until it impacts on the anvil assembly 20. The reactionary force also drives the piston 34 backward against the cup 58 and compression spring 56 and an oscillatory motion is set up at a very rapid rate. The holes 50 in the piston 34 act as air exhaust ports for the piston 34.

Considering now the anvil 20, it consists of a solid arcuate member configured in the form of a quarter segment of a circle and includes an enlarged peripheral portion 68 including a rear striking face 70, and a flat front face 72 to which is attached the descaling head 22.

The inner radial portion of the anvil 20 includes an area 74 of reduced thickness which terminates in a hub 76 which includes a bore for receiving a retainer pin 78. The pin 78 extends between the side walls 80 and 82 of the forward section 16. Thus the anvil 20 rotates on the retainer pin 76 when struck by the tip 36 of the pneumatically driven piston 34.

Both the hub 76 and pin 78 include threaded bores therethrough which can be aligned for the passage of a threaded bolt 84 therethrough. The bolt 84 is adapted to restrict the oscillatory motion of the anvil 20 in the rear direction and depends upon the length to which it is inserted toward the rear wall 86. The rear wall 86 additionally includes a fitting 88 through the wall for the attachment of a vacuum hose 90 (FIG. 1) which operates to remove dust, metal particles and other debris while the work surface is being operated on by the descaling pad 22.

Thus when the tool 10 is manually placed in contact with the workpiece with pressure being applied from above, actuation of the handle 64 initiates a rapid oscillatory type of impact motion of the descaling head 22 on the surface of the workpiece. It should be noted that the tool 10 is designed not only to fit into corners, but under low obstructions and into relatively tight spaces. Also, the rear handle portion 14 may be made removable for the replacement with handles of increased length depending upon the particular task required. Also, while the descaler head 22 is shown being generally rectangular in configuration, it should be noted that when desirable other types of heads may be used, including, for example, circular typed heads.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

We claim:

1. A hand-held impact type descaling tool, comprising:

a tool housing having a relatively longer rear handle section and a relatively shorter forward head section angulated with respect to said handle section and having a forwardly tapered nose portion for fitting into a corner of a workspace;

a pneumatically driven hammer assembly located said handle section and including a reciprocating type piston member mounted in an outer cylinder member affixed to an inner surface of the handle section;

an anvil member, having a rear end and a front end, pivotally mounted in the head section of the housing, said rear end facing said piston member and being struck thereby when actuated; and an abrasive type of descaling head attached to the front end of the anvil member for removing material from a work surface and providing a scored profile thereon.

2. The descaling tool according to claim 1 wherein the descaling head has a peripheral edge conforming to the tapered shape of the nose portion of said housing.

3. The descaling tool according to claim 2 wherein the tapered nose portion includes a pair of front walls joined together along a generally straight front edge.

4. The descaling tool according to claim 3 wherein said front walls are joined at an angle less than an obtuse angle.

5. The descaling tool according to claim 3 wherein said front walls are joined at a right angle.

6. The descaling tool according to claim 3 wherein the peripheral edge of the descaling head includes at least two linear edges meeting at a point substantially directed to said front edge.

7. The descaling tool according to claim 6 wherein the peripheral edge of the descaling head includes four linear edges defining a rectangle.

8. The descaling tool according to claim 3 wherein the head section is angulated substantially at a right angle relative to the handle section.

9. The descaling tool according to claim 8 wherein said anvil member comprises an arcuate body having a generally flat striking face at said rear end directed toward said piston member.

10. The descaling tool according to claim 9 wherein said arcuate body includes a peripheral edge defining substantially one quarter of a circle.

11. The descaling tool according to claim 10 wherein said arcuate body is connected to a hub and additionally including a pivot member extending through said hub and being secured to a pair of opposing side walls of said nose portion.

12. The descaling tool according to claim 9 and wherein said piston member of said hammer assembly includes a hardened metal tip for striking said arcuate body.

13. The descaling tool according to claim 9 wherein said piston member includes an axial bore for receiving pneumatic energy for actuating said piston member during a driving stroke.

14. The descaling tool according to claim 13 and additionally including manually activated valve means located in said handle section and being coupled to a pneumatic source for supplying pneumatic energy to said piston member for driving said piston member against the striking face of said arcuate body.

15. The descaling tool according to claim 14 and additionally including recoil spring means for buffering the recoil of said piston member located between said valve means and said piston member.

16. The descaling tool according to claim 15 wherein said recoil spring means includes a compression spring located in a generally cylindrical housing having a plurality of elongated notches formed on the outer surface thereof and running the length of said housing, and a movable end cap located at one end of said housing for retaining said compression spring.

* * * * *